United States Patent [19]

Reuillon et al.

[11] 4,149,976

[45] Apr. 17, 1979

[54] POWDER FOR EXTINGUISHING FIRES OF LIQUID SUBSTANCES OR OF A MIXTURE OF LIQUID SUBSTANCES

[75] Inventors: Marcelline Reuillon, Orleans; Henry Mellottée, Paris; Lucien Alfille, Gif-sur-Yvette; Jacques Duco, Meudon; Yves Fruchard; Jean-Claud Malet, both of Aix-en-Provence; André Chappellier, Vanves; Bernard Devillers, Orleans, all of France

[73] Assignees: Commissariat a l'Energie Atomique; Agence Nationale de Valorisation de la Recherche (ANVAR), both of Paris, France

[21] Appl. No.: 743,057

[22] Filed: Nov. 18, 1976

[30] Foreign Application Priority Data

Nov. 26, 1975 [FR] France ..... 75 36225

[51] Int. Cl.[2] ..... A62D 1/00

[52] U.S. Cl. ..... 252/5; 176/38; 252/2

[58] Field of Search ..... 176/38; 252/2, 5

[56] References Cited

U.S. PATENT DOCUMENTS 2,346,627 4/1944 Thrune ..... 252/5 X

FOREIGN PATENT DOCUMENTS 1168258 4/1964 Fed. Rep. of Germany ..... 252/2

960007 6/1964 United Kingdom ..... 252/2

*Primary Examiner*—Leland A. Sebastian

*Attorney, Agent, or Firm*—Lane, Aitken & Ziems

[57] ABSTRACT

The powder for extinguishing fires of liquid substances or of a mixture of liquid substances forming part of the group comprising liquid metals and hydrocarbons contains at least two salts of alkali metals or alkaline earth metals in proportions such as to obtain a composition having a melting point which is lower than the flame temperature of the liquid metal or of the mixture of metals to be extinguished. The powder contains water of crystallization combined with at least one of the salts, the proportion of water being within the range of 1 to 15% of the weight of the powder.

4 Claims, No Drawings

POWDER FOR EXTINGUISHING FIRES OF LIQUID SUBSTANCES OR OF A MIXTURE OF LIQUID SUBSTANCES

This invention relates to powder compositions for extinguishing fires of liquid substances and/or a mixture of liquid substances consisting either of liquid hydrocarbons or of liquid metals.

In the case of liquid metals, the compositions under consideration are more especially concerned with the need to extinguish fires of alkali or alkaline-earth liquid metals.

It is known that, especially in some types of nuclear reactor (for example fast reactors), the coolant liquid very often consists of liquid sodium or binary mixtures of metals with sodium such a NaK. In the event of accident conditions such as outleakage or a duct failure, the sodium is liable to ignite spontaneously in contact with air by reason of the high temperatures at which liquid sodium is employed in reactors of this type. It is clearly necessary to provide means for extinguishing fires of this type very rapidly. Known types of fire-extinguishing compounds are usually supplied in the form of powdered substances having varying compositions and unequal degrees of effectiveness. The majority of compounds have a base either of sodium carbonate, silica, silicates or alumino-silicates, or of alkali chlorides or alkaline-earth chlorides, or of graphite.

In the case of compounds consisting solely of mineral substances and in the case of liquid metals, re-ignitions are frequently observed unless large quantities of powder are employed. In fact, the liquid metal rises to the surface through the powder and again ignites in contact with air. These compounds make it necessary to employ a large mass of powder in order to obtain total fire suppression. In more exact terms, the ratio of weight of fire-extinguishing powder to weight of sodium is equal to or higher than 2.3. It can readily be appreciated that the spreading of large quantities of powder over burning sodium or liquid metal gives rise to major problems both in regard to storage of the powder and in regard to transfer and pouring of this latter over the liquid sodium. Finally, it is apparent that a fire can be extinguished more rapidly as the quantity of powder required is smaller. For all these reasons, it is therefore very important to employ the minimum quantity of powder for the achievement of fire suppression.

The present invention is precisely directed to fire-extinguishing powder compositions which are considerably more effective in extinguishing liquid-metal or liquid-hydrocarbon fires than has hitherto been the case with powders which are already in use.

The powder for extinguishing fires of liquid substances or of a mixture of liquid substances forming part of the group comprising liquid metals and hydrocarbons contains at least two salts of alkali metals or alkaline earth metals in proportions such as to obtain a composition having a melting point which is lower than the flame temperature of the liquid metal or of the mixture of metals to be extinguished, said powder being characterized in that it contains water in the form of water of crystallization combined with at least one of said salts, the proportion of water being within the range of 1 to 15% of the weight of the powder.

It must be pointed out that the flame temperature is the temperature attained by the combustion products in the flame zone, that is, within the zone in which the light emission is of maximum intensity. Said flame temperature can be equal at a maximum to the boiling-point of the oxide formed in said zone (in the case of metals) or below said maximum value while being equal in such a case to the temperature of decomposition of the oxide if this latter is not stable at high temperature. This is the meaning which should be given to this expression throughout the description and appended claims.

As will be understood, a radical distinction is drawn between the powder in accordance with the present invention and fire-extinguishing powder compositions of the prior art since it contains a certain quantity of water in the form of water of crystallization which is liberated when the powder is sprinkled over the burning liquid substance. The following description will show the significance attached to the presence of this water and the way this latter permits the achievement of a very substantial reduction in the quantity of fire-extinguishing powder to be employed in order to extinguish a given quantity of ignited liquid substances.

Preferably, the salts including at least one hydrated salt are selected from the group comprising the chlorides, the carbonates, the fluorides and the molybdates.

In accordance with another distinctive feature of the invention, the powder further contains a water-repellent compound which is also capable of increasing the viscosity of said powder when this latter is in the molten state. It will further be ensured that the selected compound also possesses inherent fire-extinguishing properties with respect to liquid metals and that said compound also produces a fluidizing action on the powder in the solid state in order to facilitate both transfer and sprinkling of this latter which clearly entail the need to circulate said powder within ducts.

By way of example, the powder under consideration can be constituted by at least one of the following substances: graphite which is used by way of preference, molybdenum sulphide, alumina and talcum powder.

A more complete understanding of the present invention will in any case be gained from the following description of a number of embodiments of the invention which are given by way of example without any limitation being implied.

There will now be given concrete examples of utilization of compositons by weight of powder in accordance with the invention. In order to compare the effectiveness of powders, a convenient expedient consists in comparing the weights of the powders employed for fire-suppression with the weight of ignited liquid metal.

EXAMPLE 1

10 g of sodium were placed in a stainless steel crucible having a cross-sectional area of 11 $cm^2$ and maintained at 550° C. The sodium ignited spontaneously when put in the presence of dry air within a closed vessel having a sufficiently large volume to permit of total combustion. After allowing the combustion to proceed, 10 g of powdered mixture (having a particle size of less than 200 $\mu$m) were sprinkled over the burning sodium. Said mixture comprised 55% by weight of monohydrated $Na_2CO_3$, 40% by weight of NaCl and 5% by weight of graphite. A yellow luminescence appeared in the vapor phase for a short period of a few seconds, whereupon total fire-suppression was achieved in spite of the fact that the sodium was maintained at a temperature of 550° C.

Practically immediate and complete fire suppression can still be obtained by sprinkling smaller quantities of the fire-extinguishing mixture, down to a limit of approximately 5 g. The minimum ratio (weight of extinguishant to weight of sodium) is then in the vicinity of 0.5 instead of 2.3 in the case of the currently available commercial product which has given the best results under identical test conditions.

EXAMPLE 2

Under the same conditions as in Example 1, 20 g of the fire-extinguishing mixture composed of 61.4% $Na_2CO_3$, $H_2O$ and 38.6% NaCl were abruptly sprinkled over the burning sodium. After a brief luminescence of a few seconds duration, the fire was completely extinguished.

EXAMPLE 3

10 g of sodium were placed in a stainless steel crucible which was brought to a temperature of 550° C. The crucible was then removed from the furnace which had maintained it at this temperature and placed in the presence of a forced circulation of natural air. The combustion of the sodium was highly accelerated. There was then progressively sprinkled on the burning sodium over a period of 10 seconds a mixture of 53.3% by weight of $Na_2CO_3$, $H_2O$, 39.2% by weight of NaCl and 7.5% by weight of graphite. The sodium was completely extinguished in respect of a quantity of extinguishing mixture as small as 4.8 g, namely a ratio (weight of extinguishant to weight of sodium) of the order of 0.5.

In more general terms, the proportion of sodium carbonate is between 30 and 65%, the proportion of sodium chloride is between 35 and 70% and the proportion of graphite is between 0 and 20%.

EXAMPLE 4

Under the conditions of Example 1, a mixture of 10 g consisting of 42.6% by weight of $Li_2CO_3$, 47.4% by weight of $Na_2CO_3$, $H_2O$ and 10% by weight of graphite was abruptly sprinkled over 10 g of burning sodium. Fire suppression was immediate and permanent.

Similarly, it is possible in more general terms to employ 30 to 65% sodium carbonate, 35 to 70% lithium carbonate and 0 to 20% graphite.

EXAMPLE 5

Under the same conditions as in Example 1, 5 g of extinguishing mixture composed of 32.5% by weight of NaF, 60% by weight of $Na_2CO_3$, $H_2O$ and 75% by weight of graphite were rapidly sprinkled over the burning sodium. A luminescence of a few seconds duration preceded complete fire-suppression.

Similar results are obtained when the composition of the extinguishing mixture varies. Thus the proportion of sodium carbonate is 40 to 85%, the proportion of sodium fluoride is 15 to 60% and the proportion of graphite is 0.20%.

EXAMPLE 6

Under the conditions of Example 1, 10 g of extinguishing mixture composed of 40 % by weight of NaCl, 55% by weight of $Na_2CO_3$, $H_2O$ and 5% by weight of alumina were abruptly sprinkled over the sodium fire. There was immediately observed in the gas phase a luminescence which lasted a few seconds and was followed by complete suppression of the fire.

EXAMPLE 7

Under the conditions of Example 1, 10 g of extinguishing mixture composed of 36% by weight of NaCl, 49% by weight of $Na_2CO_3$, $H_2O$ and 15% by weight of molybdenum sulphide were abruptly sprinkled over 10 g of burning sodium. After a luminescence having a duration which did not exceed a few seconds, fire-suppression was total and permanent.

Similarly, it is possible in a more general manner to employ 20 to 65% sodium chloride, 35 to 80% sodium carbonate and 0 to 30% molybdenum sulphide.

EXAMPLES 8

In these examples, the following composition was employed:

—hydrated $Na_2CO_3$ containing 10% by weight of water: 48%

—$Li_2CO_3$: 43%

—Graphite: 9%

The melting point of this binary mixture of sodium carbonate and lithium carbonate is equal to 604° C.

A first test was carried out on 10 kg of sodium placed in a tank and the free surface of the sodium had an area of 1963 $cm^2$. The temperature of the sodium at the moment of sprinkling was 532° C. By sprinkling 5.5 kg of this powder, complete fire-suppression was obtained with the formation of a rigid and hard crust at the surface of the sodium.

In another test having the same powder composition, 260 kg of sodium were ignited within a tank in which the free surface of sodium was 2 $m^2$ and the temperature of the sodium at the moment of sprinkling was 600° C. By employing 100 kg of powder which was poured over a period of 15 seconds, it was possible to establish the facts mentioned below.

As soon as the powder-sprinkling operation had been completed, there was obtained total fire-suppression with formation of a hard and rigid crust.

The function of the water in the form of water of crystallization appears to be a double one. On the one hand, the water reacts locally with the sodium in order to produce sodium hydroxide which has the effect of isolating the mass of ignited liquid metal from the surrounding air and consequently of producing favorable conditions for extinguishing this latter. Moreover, the water which is formed produces action on the powder mechanically so as to form agglomerates of powder grains which improve the resistance of the isolating layer and thus prevent upward motion of the burning liquid metal. In order to provide a more precise illustration of the function performed by the water which is present in the powder in the form of water of crystallization under the conditions of Example 1, there will now be described two series of experiments involving the use of a powder having the following composition: $Na_2CO_3$=57.6%, NaCl=42.4% (corresponding melting point: 645° C.). These experiments were carried out as follows:

(a) The first experiment consisted at the outset in making use of anhydrous sodium carbonate. 21 g of powder of this substance did not prove sufficient to extinguish the 10 g of sodium which had been placed within the crucible. Reignition took place almost immediately.

(b) The same experiment was again carried out with a hydrated sodium carbonate containing different proportions of water. There was employed a sodium carbonate containing 10, 12, 14.5 and 15% of crystallization water. In all cases, complete suppression of the sodium fire was obtained with 10 g of powder: this quantity must clearly be compared with the 21 g of powder which had not been capable of producing this suppression.

EXAMPLES 9

Using the same composition of powder as that defined in Examples 8, experiments were carried out for extinguishing fires of other liquid metals. The liquid metal was placed within a crucible having a surface area equal to 133 $cm^2$.

—Potassium: 200 g of potassium placed within this crucible were extinguished with 130 g of the powder defined in the foregoing.

—Calcium: by placing 100 g of calcium within the same crucible, fire-suppression was obtained with 80 g of powder. The maximum temperature recorded in the liquid metal was 1020° C.

—Magnesium: within the same crucible, there were placed 90 g of magnesium. After pouring 35 g of the powder, complete suppression of the fire was obtained. The maximum temperature recorded in the liquid metal was 800° C.

Substances other than sodium carbonate can obviously be employed as anhydrous salts. For example, it is possible to employ $BaCl_2$, $2H_2O$ which produce BaCl by heating to 150° C. Similarly, it is possible to employ $K_2CO_3$, $2H_2O$ and LiCl, $H_2O$. The following examples can be given in this connection.

EXAMPLES 10

Under the experimental conditions of Example 1 and using 10 g of a mixture of $Li_2CO_3$ (74%) and $K_2CO_3$ (26%), momentary fire-suppression was obtained (of the order of 10 seconds), whereupon re-ignitions appeared.

On the contrary under the experimental conditions of Example 1 when using 10 g of $Li_2CO_3$ (68%) - $K_2CO_3$, 2 $H_2O$ (32%), complete fire-suppression of 10 g of sodium maintained at 550° C. was obtained and the mixture formed a layer of paste consistency at the surface of the metal.

Similarly, under the experimental conditions of Example 1 with 7 g of $Li_2CO_2$ (61.9%) - $K_2CO_3$, $2H_2O$ (29.1%), graphite (9%), fire-suppression of the 10 g of sodium which are maintained at 550° C. is complete.

EXAMPLES 11

Under the experimental conditions of Example 1 and using 15 g of a mixture of $BaCl_2$ (65.3%) and KCl (34.7%), momentary fire-suppression was obtained followed by the appearance of re-ignitions.

On the contrary, under the experimental conditions of Example 1, there is obtained with 15 g of mixture of $BaCl_2$, $2H_2O$ (68.8%), KCl (31.2%), complete suppression of 10 g of sodium maintained at 550° C. is achieved.

Similarly, under the experimental conditions of Example 1, 7 g of $BaCl_2$, $2H_2O$ (61.9%), KCl (28.1%), graphite (10%) are sufficient to extinguish the fire of the 10 g of sodium maintained at 550° C.

EXAMPLES 12

Under the experimental conditions of Example 1 and using 10 g of a mixture of $BaCl_2$ (74%) and NaCl (26%), momentary suppression was obtained followed by the appearance of re-ignitions.

On the contrary, under the experimental conditions of Example 1, the 10 g of sodium are completely extinguished by means of 10 g of the mixture of $BaCl_2$, $2H_2O$ (77.3%), NaCl (22.7%).

Similarly, under the experimental conditions of Example 1, 6 g of a mixture of $BaCl_2$, $2H_2O$ (71.1%), NaCl (20.9%), 8% of graphite are sufficient to extinguish 10 g of sodium.

In order to obtain the percentages of water of crystallization mentioned earlier, the hydrated salt is provided in the form X, $nH_2O$, wherein X represents the anhydrous salt and n represents a number between 0 and 3, whether a whole number or not.

The existence of the upper limit can be explained by the fact that, if the water content is too high, there takes place as a result of the reaction of the ignited metal with water, namely $Na+H_2O$ in the case of sodium (or with a metal other than sodium) an evolution of hydrogen which is liable to produce explosive mixtures with the surrounding air.

As mentioned earlier, the powder compositions already described are not only efficacious for extinguishing fires of liquid metals but also for extinguishing fires of liquid hydrocarbons such as fuel-oil or gasoline.

It should nevertheless be pointed out that the mode of projection of the powder is slightly different. In the case of liquid metal, it is endeavored to form a deposit on the surface of the liquid in such a manner as to avoid the presence of eddies. In the case of liquid hydrocarbons, the powder is projected into the flame zone, that is to say the light zone.

The following example illustrates the effectiveness of these compositions for extinguishing liquid-hydrocarbon fires.

EXAMPLE 13

A tank was filled with 20 liters of gasoline and 10 liters of fuel-oil. The free surface of the liquid had an area of 1.80 $m^2$.

A quantity of 1.5 kilograms of powder was projected onto the mixture of hydrocarbons. The mixture employed was as follows in composition by weight:

—hydrated $Na_2CO_3$ containing 10% water: 48%

—$Li_2CO_3$: 43%

—Graphite: 9%

Practically instantaneous and total fire-suppression was obtained, the flame temperature was of the order of 800° C.

What we claim is:

1. A powder for extinguishing fires of liquid substances or of a mixture of liquid substances comprising hydrocarbons and liquid metals said powder containing 30–65% hydrated sodium carbonate, 70–30% sodium chloride and 0–20% graphite, the powder having a melting point which is lower than the flame temperature of the liquid substance or the mixture of the liquid substances to be extinguished and containing water of crystallization in the amount of from 1 to 15% of the weight of the powder.

2. A powder for extinguishing fires of liquid substances or of a mixture of liquid substances comprising hydrocarbons and liquid metals said powder containing 30–65% hydrated sodium carbonate, 70–35% lithium carbonate and 0–20% graphite, the powder having a melting point which is lower than the flame temperature of the liquid substance or the mixture of the liquid substances to be extinguished and containing water of crystallization in the amount of from 1 to 15% of the weight of the powder.

3. A powder for extinguishing fires of liquid substances or of a mixture of liquid substances comprising hydrocarbons and liquid metals said powder containing 40–85% hydrated sodium carbonate, 15–60% sodium chloride and 0–20% graphite, the powder having a melting point which is lower than the flame temperature of the liquid substance or the mixture of the liquid substances to be extinguished and containing water of crystallization in the amount of from 1 to 15% of the weight of the powder.

4. A powder for extinguishing fires of liquid substances or of a mixture of liquid substances comprising hydrocarbons and liquid metals said powder containing 20–65% sodium chloride, 35–80% hydrated sodium carbonate and 0–30% molybdenum sulfite, the powder having a melting point which is lower than the flame temperature of the liquid substance or the mixture of the liquid substances to be extinguished and containing water of crystallization in the amount of from 1 to 15% of the weight of the powder.

* * * * *